US007710325B2

(12) United States Patent
Cheng

(10) Patent No.: US 7,710,325 B2
(45) **Date of Patent: *May 4, 2010**

(54) MULTI-BAND DIELECTRIC RESONATOR ANTENNA

(75) Inventor: Dajun Cheng, Acton, MA (US)

(73) Assignee: Intel Corporation, Santa Clara, CA (US)

( * ) Notice: Subject to any disclaimer, the term of this patent is extended or adjusted under 35 U.S.C. 154(b) by 831 days.

This patent is subject to a terminal disclaimer.

(21) Appl. No.: 11/464,774

(22) Filed: Aug. 15, 2006

(65) Prior Publication Data

US 2008/0042903 A1 Feb. 21, 2008

(51) Int. Cl.
*H01Q 1/38* (2006.01)

(52) U.S. Cl. ..... 343/700 MS; 343/732

(58) Field of Classification Search ..... None
See application file for complete search history.

(56) References Cited

U.S. PATENT DOCUMENTS 5,453,754 A 9/1995 Fray
5,714,961 A * 2/1998 Kot et al. ..... 343/769
5,940,036 A 8/1999 Oliver et al.
5,952,972 A 9/1999 Ittipiboon et al.
6,118,406 A * 9/2000 Josypenko ..... 343/700 MS
6,147,647 A 11/2000 Tassoudji et al.
6,184,828 B1 * 2/2001 Shoki ..... 342/372
6,198,450 B1 3/2001 Adachi et al.
6,323,808 B1 11/2001 Heinrichs et al.
6,323,824 B1 11/2001 Heinrichs et al.
6,344,833 B1 2/2002 Lin et al.
6,373,441 B1 4/2002 Porath et al.
6,407,718 B2 6/2002 Adachi et al.
6,452,565 B1 9/2002 Kingsley et al.
6,597,316 B2 * 7/2003 Rao et al. ..... 343/700 MS
6,801,164 B2 10/2004 Bit-Babik et al.
6,816,118 B2 11/2004 Kingsley et al.
6,876,328 B2 * 4/2005 Adachi et al. ..... 343/700 MS
6,900,764 B2 5/2005 Kingsley et al.
6,903,692 B2 6/2005 Kivekas et al.
6,995,713 B2 2/2006 Le Bolzer et al.
7,042,416 B2 5/2006 Kingsley et al.
7,071,879 B2 7/2006 Strickland
7,289,064 B2 * 10/2007 Cheng ..... 343/700 MS

OTHER PUBLICATIONS

Mongia, R.K., A. Ittipiboon, and M. Cuhaci, "Measurement of Radiation Efficiency of Dielectric Resonator Antennas", IEEE Microwave and Guided Wave Letters, vol. 4, No. 3, Mar. 1994, pp. 80-82.

(Continued)

*Primary Examiner*—Trinh V Dinh
(74) *Attorney, Agent, or Firm*—Konrad Raynes & Victor LLP; David W. Victor

(57) ABSTRACT

Provided is an antenna comprising a first dielectric resonator antenna operative within a first frequency band, a second dielectric resonator antenna operative within a second frequency band, and a feeding structure electrically coupled to the first and second dielectric resonator antennas to receive and transmit signals at the first and second frequency bands through the first and second dielectric resonator antennas.

34 Claims, 11 Drawing Sheets

OTHER PUBLICATIONS

Petosa, A., A. Ittipiboon, Y.M.M. Antar, D. Roscoe, and M. Cuhaci, "Recent Advances in Dielectric-Resonator Antenna Technology", IEEE Antennas and Propagation Magazine, vol. 40, No. 3, Jun. 1998, pp. 35-48.

Thaysen, J. and K.B. Jakobsen, "A Size Reduction Technique for Mobile Phone PIFA Antennas Using Lumped Inductors", [online], Jul. 6, 2005, [Retrieved on May 12, 2006], 9pp, retrieved from the Internet at <URL: http://www.mwjournal.com/journal/print.asp?Id=AR_297>.

U.S. Appl. No. 11/209,218, filed Aug. 23, 2005, entitled "Compact Multi-Band, Multi-Port Antenna", invented by D. Cheng.

* cited by examiner

Multi-Band Dielectric Antenna

Multi-Band Dielectric Antenna

MULTI-BAND DIELECTRIC RESONATOR ANTENNA

BACKGROUND

Many wireless devices, systems, platforms, and components exist and are being developed that are capable of operation within multiple frequency bands. For example, devices such as cellular telephones, personal digital assistants (PDAs), portable computers, and others may include cellular telephone functionality that is operative within one frequency band, wireless networking functionality that is operative within another frequency band, and Global Positioning System (GPS) functionality that is operative within yet another frequency band, all within a single device. Typically, a different antenna would be used for each function. However, the use of multiple separate antennas within a device can require a relatively large amount of space, especially with respect to smaller form factor wireless devices.

DETAILED DESCRIPTION

In the following description, reference is made to the accompanying drawings which form a part hereof and which illustrate several embodiments. It is understood that other embodiments may be utilized and structural and operational changes may be made without departing from the scope of the embodiments.

Figure 1A:
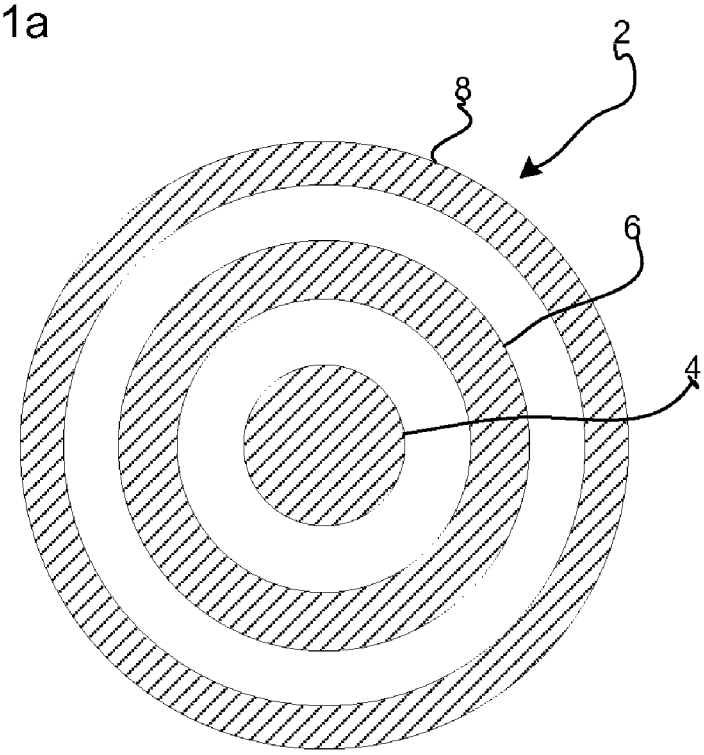
FIGS. 1*a*, 1*b*, and 2 illustrate embodiments of an arrangement of dielectric resonator antennas in a multi-band dielectric resonator antenna.
Figure 1B:
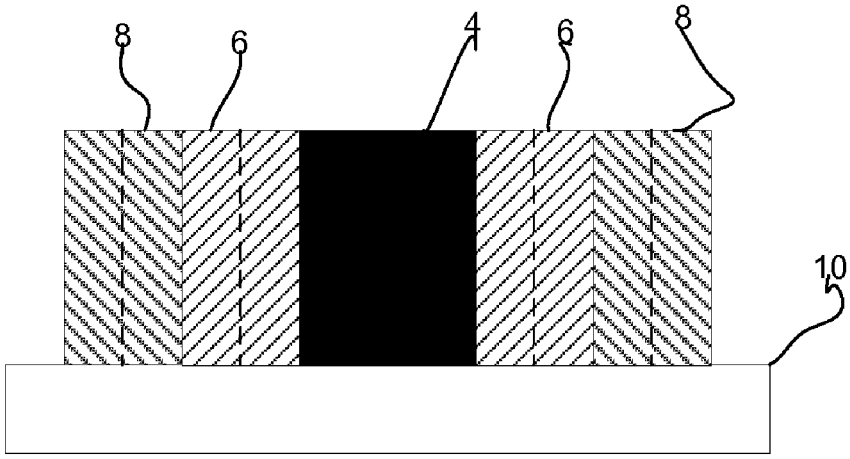
Figure 2:
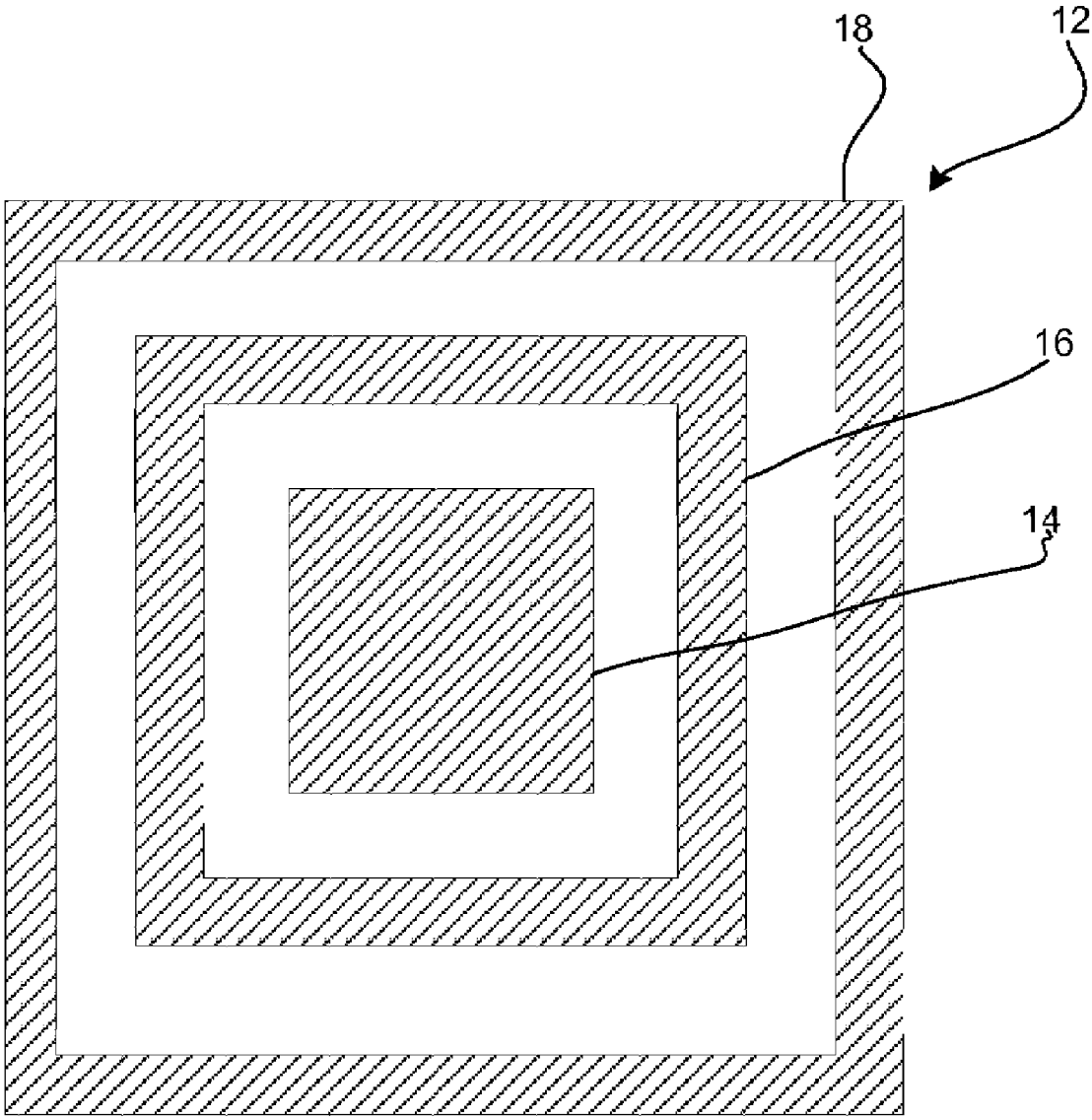

FIGS. 1*a* and 2 are top views illustrating arrangements of multi-band dielectric resonator antennas 2 and 12, respectively. FIG. 1*a* shows an arrangement of a multi-band antenna 2 having three dielectric resonator antennas 4, 6, and 8, where the antennas 4, 6, and 8 have a circular shape. FIG. 1*b* illustrates a lateral cross-sectional view of the dielectric antenna of FIG. 1*a*, where the antennas 4, 6, and 8 are positioned on a substrate 10.

FIG. 2 shows a top view of an alternative embodiment of a multi-band dielectric antenna 12 with three dielectric resonator antennas 14, 16, and 18 having a square or rectangular shape. Each of the dielectric resonator antennas 6, 8 and 16, 18 and the inner-most elements 4 and 14 have different resonating frequencies. For instance, the outer antennas, e.g., rings, 8 and 18 correspond to the central frequency of the lowest operating frequency band, the internal antennas 4 and 14 have the highest frequency band, and the middle ring antennas 6 and 16 operate at a middle frequency band. The radiation antennas are sequentially and concentrically placed inside the other ring antenna(s) with larger physical size(s) and the dielectric antennas 4 and 14 arranged in the center area. With the described embodiments, the radiation volume of the dielectric resonator antenna is reusable at all frequency bands to minimize the space required for the three separate dielectric resonator antennas.

Because the resonating frequency of dielectric radiation antennas are directly related to their electrical properties and physical dimensions, size compactness can be achieved by using dielectric materials with high permittivity (typical $\in_r$ in the range from 30 to 100). Furthermore, flexibility in dimensions may be achieved by forming the radiation antennas 4, 6, 8 and 14, 16, 18 to be plate-shaped, i.e., having a large area in the x-y dimension but thin in the z dimension). Alternatively, the elements 4, 6, 8 and 14, 16, 18 may be rod-shaped, i.e., having a small area in the x-y dimensions but long in the z dimension. Further, because each of the radiation elements 4, 6, 8 and 14, 16, 18 operate at different resonating frequency bands, the electromagnetic coupling among the radiation elements is minimal. Other shapes of the dielectric resonator antennas are also possible, such as octagonal and elliptical. However, in certain embodiments, the different dielectric resonator antennas in one multi-band dielectric resonator antenna may all have the same general shape, e.g., circular, square, rectangular, polygonal, elliptical, etc. Further, there may be two dielectric resonator antennas or more than three dielectric resonator antennas in the structure.

In the described embodiments each dielectric radiation antenna/element 4, 6, 8 and 14, 16, 18 services a different frequency band. The frequency bands that may be targeted by one or more of the dielectric resonator antennas 4, 6, 8 and 14, 16, 8 may operate at frequency bands used for cellular wireless communication, such as Global System For Mobile Communications (GSM), General Packet Radio Service (GPRS), Advanced Mobile Phone System (AMPS), Code Division Multiple Access (CDMA), wideband CDMA (WCDMA), CDMA 2000, etc. Similarly, one or more of the antennas 4, 6, 8 and 14, 16, 18 may operate at frequency bands used for wireless network communication, such as IEEE 802.11x, Bluetooth, HIPERLAN 1, 2, Ultrawideband, HomeRF, WiMAX, etc. Different bands associated with the radiation elements 4, 6, 8 in one multi-band antenna 2 may be used to service cellular and wireless communication frequency bands. One or more of the antennas 4, 6, 8, and 14, 16, 18 may operate at frequency bands used for other wireless applications, such as GPS, and mobile television.

Different feeding schemes may be used for the dielectric resonator antennas 4, 6, 8 and 14, 16, 18 to couple the signal to a transceiver. FIGS. 3-8 illustrate different feeding structures that may be used to couple to the antenna 4, 6, 8 and 14, 16, 18 signal.

Figure 3:
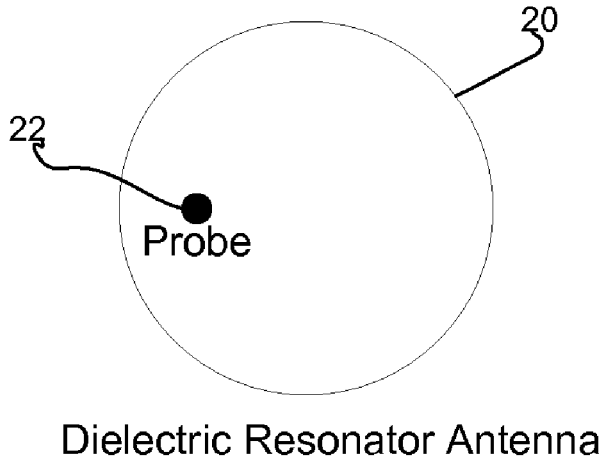
FIGS. 3-15 and 17 illustrate embodiments of feeding structures utilizing feeding structures to couple to the dielectric resonator antennas shown in FIGS. 1 and 2.

FIG. 3 illustrates a top cross-sectional view of a feeding structure embodiment. A dielectric resonator antenna 20, e.g., 4, 6, 8 and 14, 16, 18, is coupled to a probe 22 feeding structure. There is a separate probe 22 for each antenna 4, 6, 8 and 14, 16, 18 in a multi-band antenna 2, 12.

Figure 4:
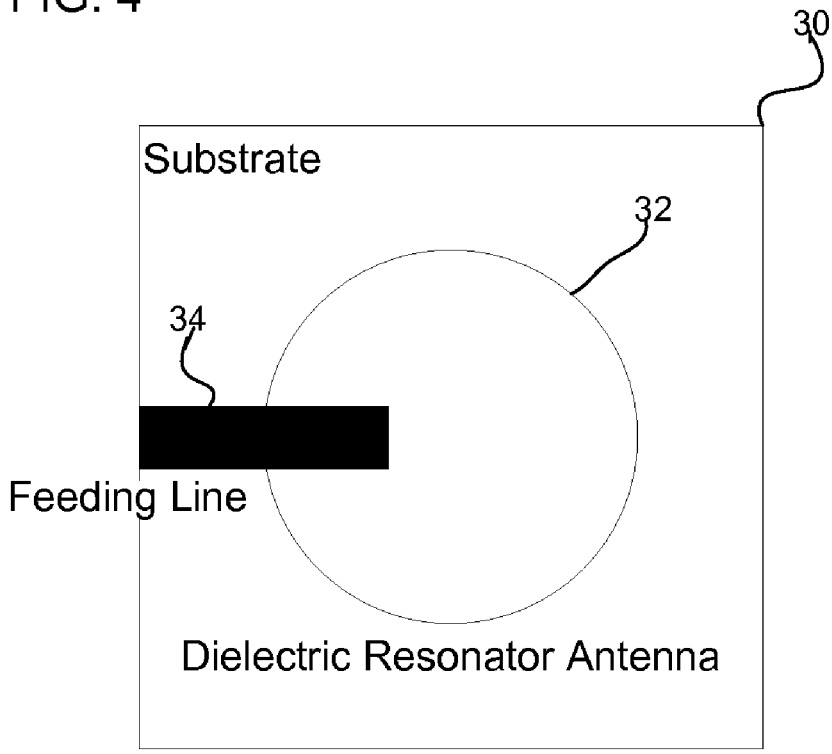

FIG. 4 illustrates a top cross-sectional view of a feeding structure embodiment. A substrate 30 has a dielectric resonator antenna 32, e.g., 4, 6, 8 and 14, 16, 18, coupled to a feeding line 34 feeding structure. In the embodiment of FIG. 4, the dielectric resonator antenna 32 is coupled directly to the feeding line 34 or feeding structure. In one embodiment, each of the antennas, e.g., e.g., 4, 6, 8 and 14, 16, 18, in one multi-band antenna 2 and 12 may have their own separate feeding line or each of the antennas, e.g., 4, 6, 8 and 14, 16, 18, in one multi-band antenna 2 and 12, may be coupled to directly (or indirectly through a coupling slot) to a same shared feeding line.

Figure 5:
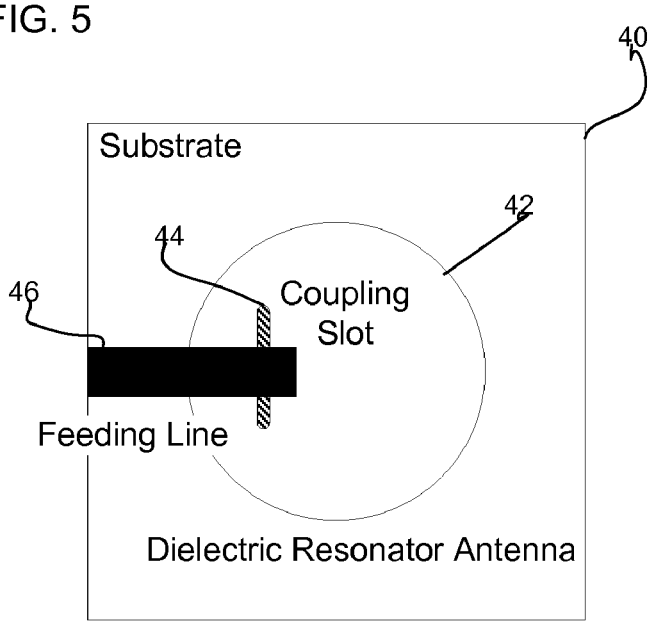

FIG. 5 illustrates a top cross-sectional view of a feeding structure embodiment. A substrate 40 is placed beneath a dielectric resonator antenna 42, e.g., 4, 6, 8 and 14, 16, 18, coupled to a feeding structure comprising a coupling slot 44 coupled to a feeding line 46. The dielectric resonator antenna 42 is placed on the top of the ground plane of the substrate 40. The coupling slot 44, etched on the ground plane of the substrate 40, couples the electromagnetic signal between the feeding line and the dielectric resonator antenna 42. In one embodiment, each of the antennas 4, 6, 8 and 14, 16, 18 in one multi-band antenna 2 and 12 may have their own coupling slot 44 and feeding line 46. Alternatively, each of the antennas 4, 6, 8 and 14, 16, 18 may have their own coupling slot coupled to a shared feeding line. The feeding line 46 may comprise a coplanar waveguide signal line or a microstrip signal line.

Figure 6:
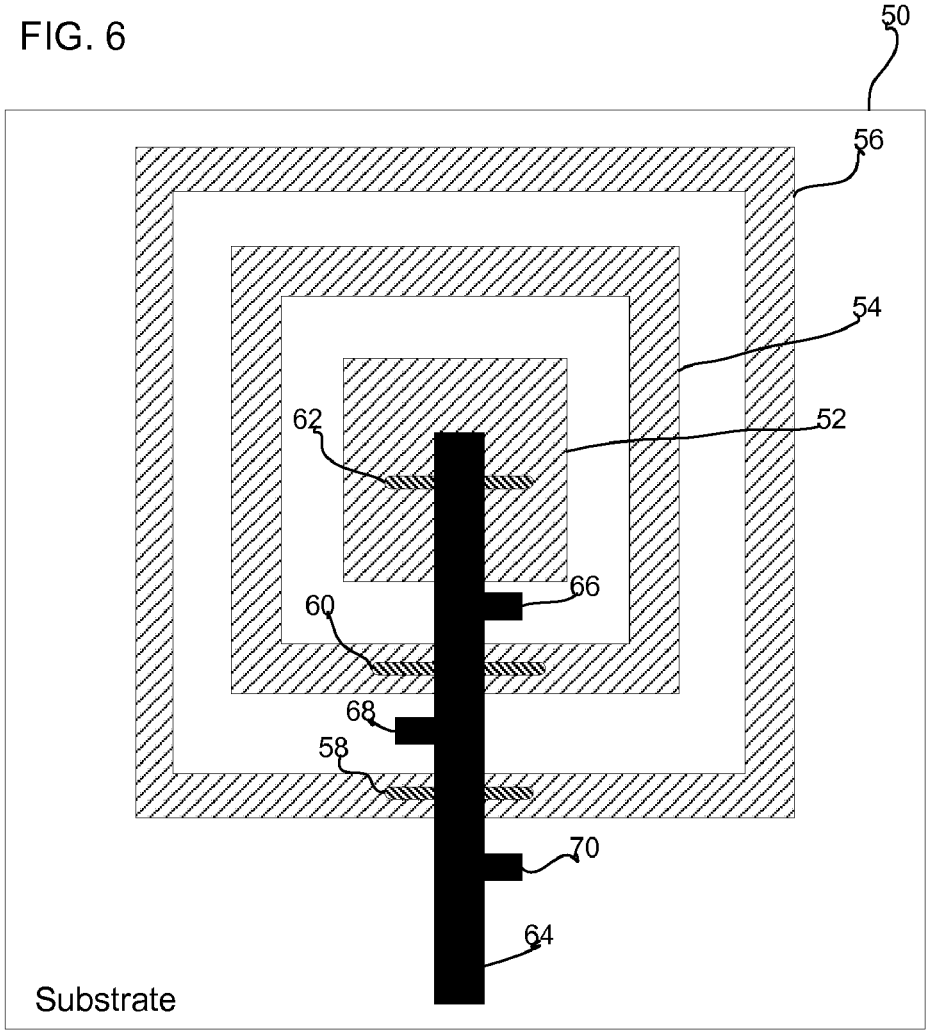

FIG. 6 illustrates a top cross-sectional view of a feeding structure embodiment. A substrate 50 of a multi-band antenna is placed beneath the dielectric resonator antennas 52, 54, and 56, each coupled to a dedicated coupling slot 58, 60, and 62, respectively. The dielectric resonator antennas 52, 54, 56 are placed on the top of the ground plane of the substrate 50, and the coupling slots 58, 60, 62 are etched on the ground plane of the substrate 50. The coupling slots 58, 60, and 62 are coupled to a shared feeding line 64. Thus the different signals for the different antennas 52, 54, and 56 are transmitted through a common feeding line 64 via separate coupling slots 58, 60, and 62.

In a further embodiment, each of the antennas 52, 54, and 56 may be associated with a separate feeding line tuning stub 66, 68, and 70, respectively, coupled to the feeding line 64 to perfect the impedance match if the impedance in the signal from the antenna 52, 54, and 56 does not match the impedance in the feeding line 64.

Figure 7:
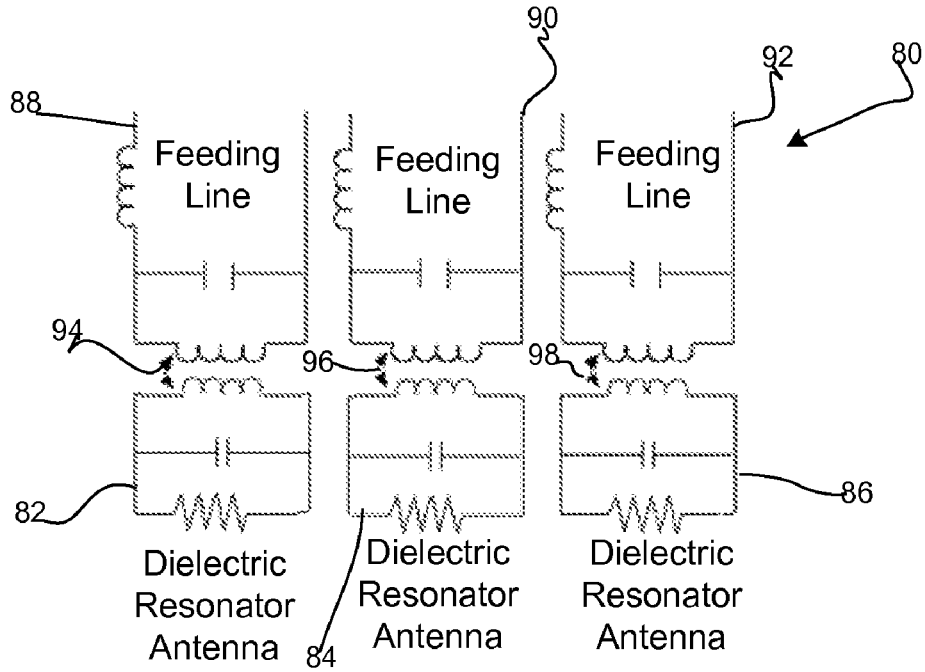

FIG. 7 illustrates an equivalent electric circuit diagram of an embodiment of a tri-band antenna 80, where each of the three dielectric resonator antennas 82, 84, and 86 are coupled to a corresponding separate feeding line 88, 90, and 92, respectively, via a feeding coupling 94, 96, and 98, respectively.

Figure 8:
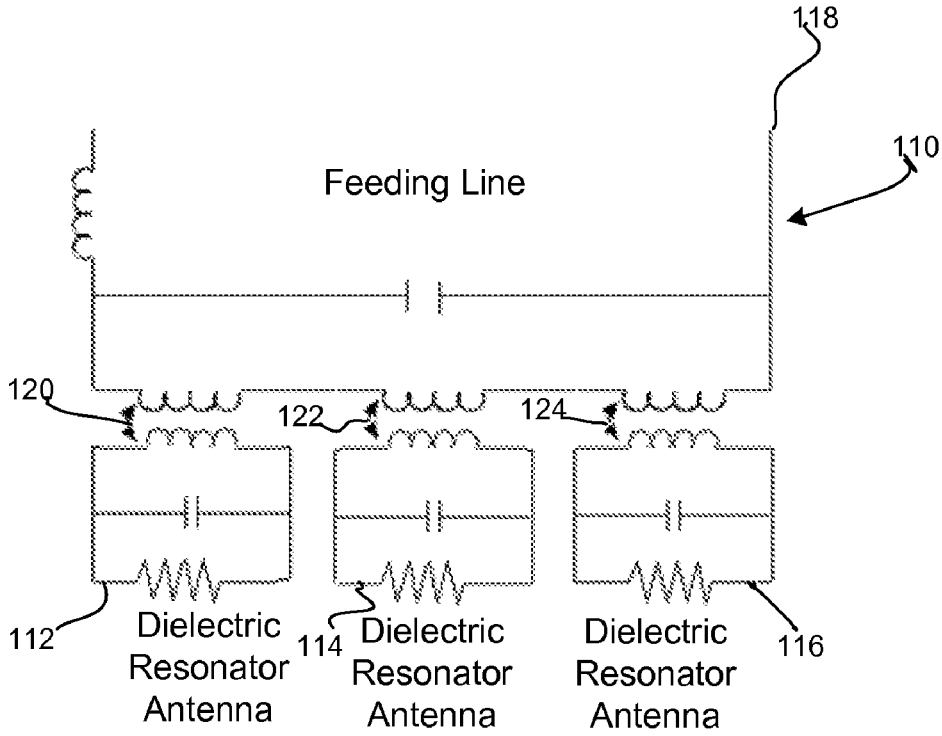

FIG. 8 illustrates an equivalent electric circuit diagram of the embodiment of FIG. 6 of a tri-band antenna 110, where each of the three dielectric resonator antennas 112, 114, and 116 are coupled to a shared feeding line 118 via feeding couplings 120, 122, and 124, respectively.

In the embodiments of FIGS. 3-8, each feeding line may pass through a separate port to transfer the signal to a coupled communication transceiver.

Figure 9:
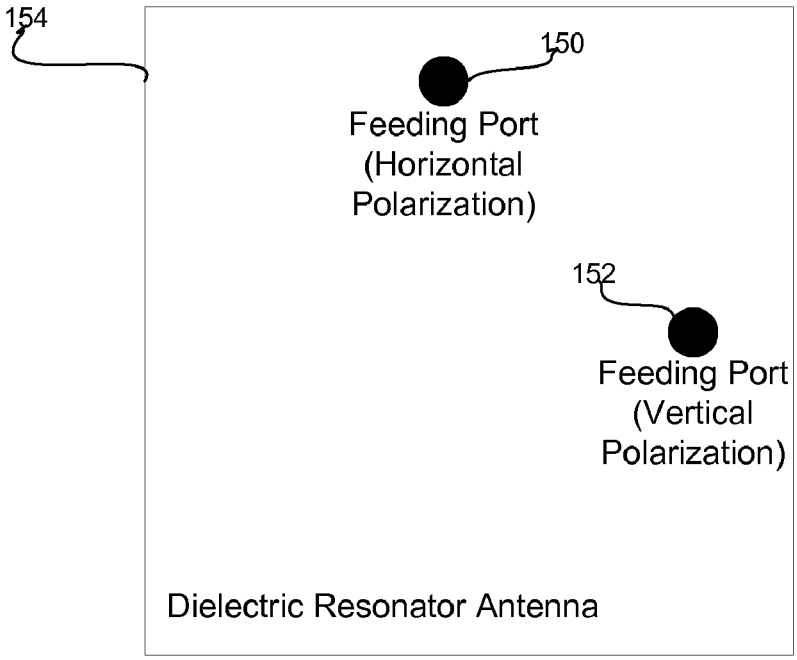

FIG. 9 illustrates a top cross-sectional view of a feeding structure embodiment for a dual-polarization embodiment. Feeding structures comprising ports 150 and 152 are coupled to a dielectric resonator antenna 154, e.g., 4, 6, 8 and 14, 16, 18. Feeding port 150 transmits that portion of the signal having horizontal polarization and feeding port 152 transmits that portion of the signal having vertical polarization. Probes may extend through the ports 150 and 152 to couple to the dielectric resonator antenna 154 to transmit the signal. There would be a separate pair of ports 150, 152 or other feed structures, such as a probe or strip, for each antenna, e.g., 4, 6, 8 and 14, 16, 18, in the multi-band antenna 2, 12.

Figure 10:
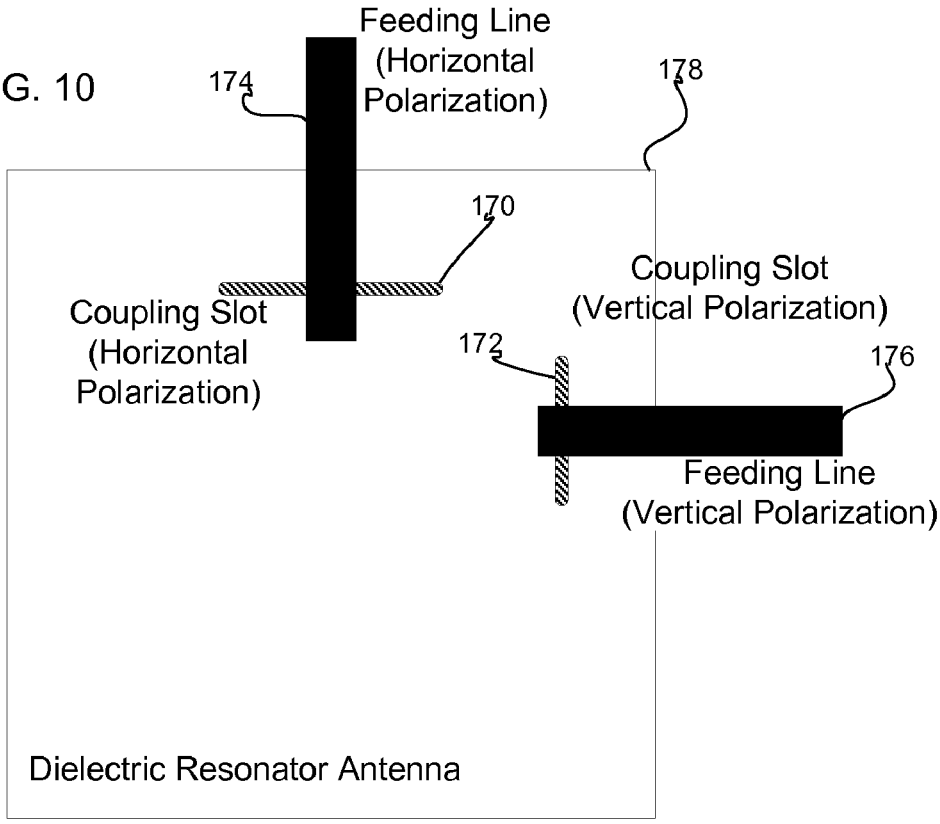

FIG. 10 illustrates a top cross-sectional view of an additional dual-polarization feeding structure embodiment. Feeding structures comprising coupling slots 170 and 172 are coupled to feeding lines 174 and 176, which are coupled to a dielectric resonator antenna 178, e.g., 4, 6, 8 and 14, 16, 18. Feeding slot 170 transmits that portion of the signal having horizontal polarization and coupling slot 172 transmits that portion of the signal having vertical polarization.

Figure 11:
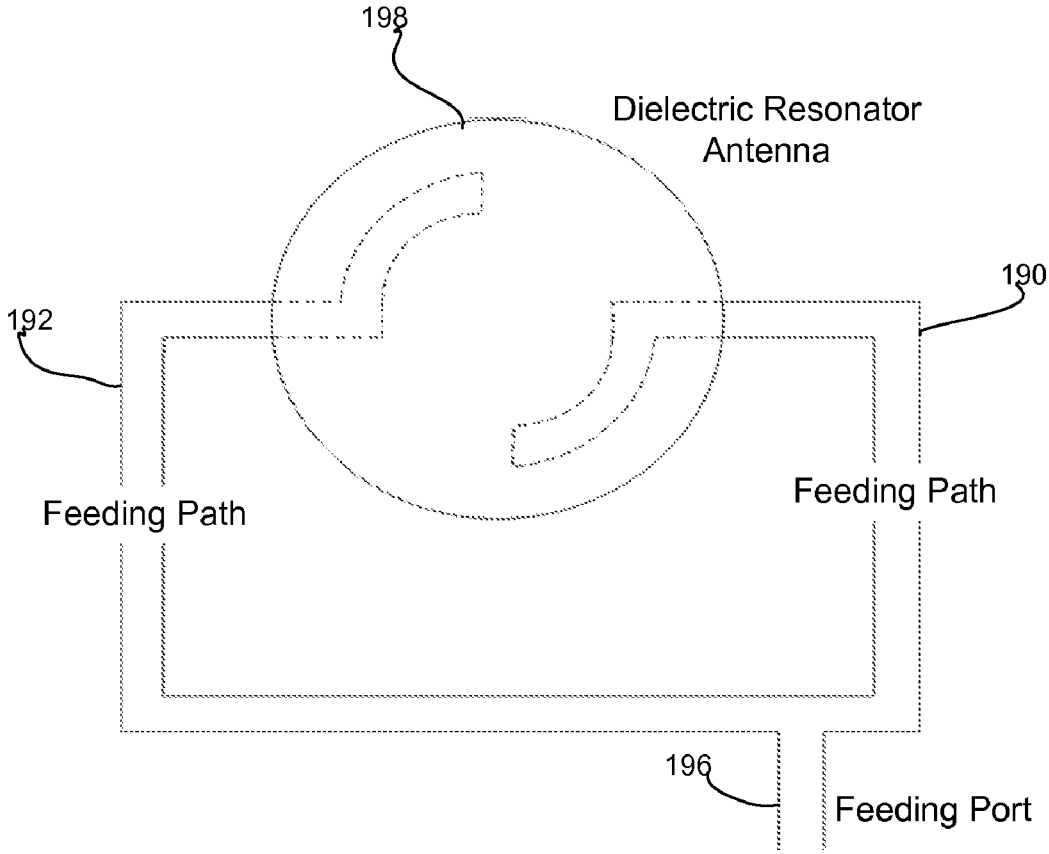

FIG. 11 illustrates a top cross-sectional view of a feeding structure to improve polarization purity. The feeding structure comprises two feeding paths 190 and 192 extending from feeding port 196. The ends of the feeding paths 190 and 192 are coupled to a dielectric resonator antenna 198, e.g., 4, 6, 8 and 14, 16, 18, and separated by a gap. The feeding paths 190 and 192 have a phase difference, such as 180 degrees. In the embodiment of FIG. 11, the signal from the antenna 196 is unbalanced. A balun (not shown) may be used to convert an unbalanced signal from the antenna 198 to a balanced signal for transmission through the feeding paths 190 and 192.

Figure 12:
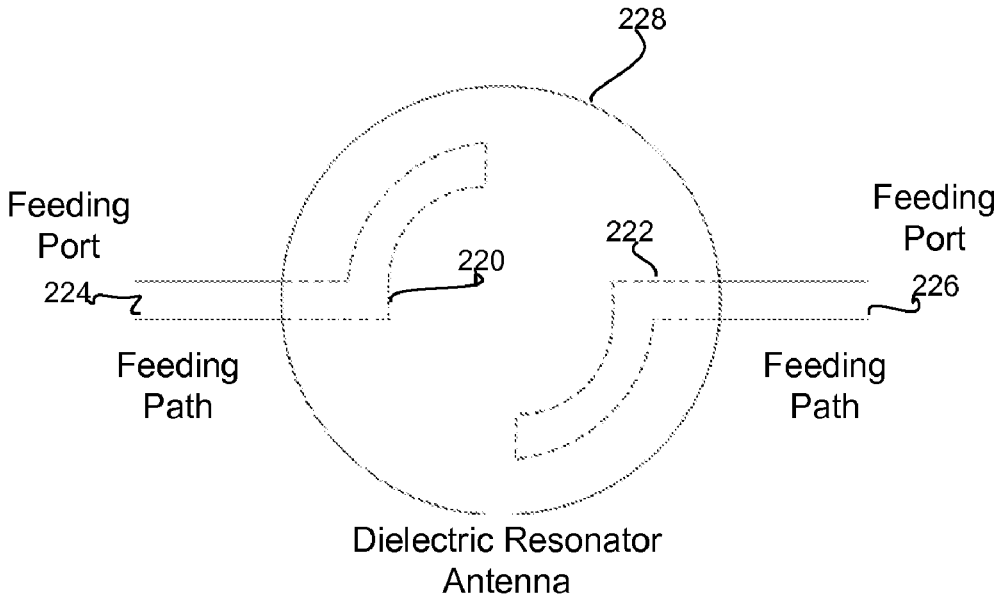

FIG. 12 illustrates a top cross-sectional view of a feeding structure to improve polarization purity. The feeding structure comprises two feeding paths 220 and 222 extending from feeding ports 224 and 226, respectively. The ends of the feeding paths 220 and 222 are coupled to a dielectric resonator antenna 228, e.g., 4, 6, 8 and 14, 16, 18, and separated by a gap. The feeding paths 190 and 192 have a phase difference, such as 180 degrees. In the embodiment of FIG. 12, the signal from the antenna 228 is balanced.

In certain embodiments, different antennas, e.g., 4, 6, and 8, in a multi-band antenna 2 may use the feeding structure embodiments of FIGS. 11 and 12, depending on whether the signal is unbalanced (FIG. 11) or balanced (FIG. 12).

In FIGS. 9, 10, 11 and 12, if the two feeding points have 90 degree phase difference, circular polarization may be implemented for GPS and mobile TV applications.

Figure 13:
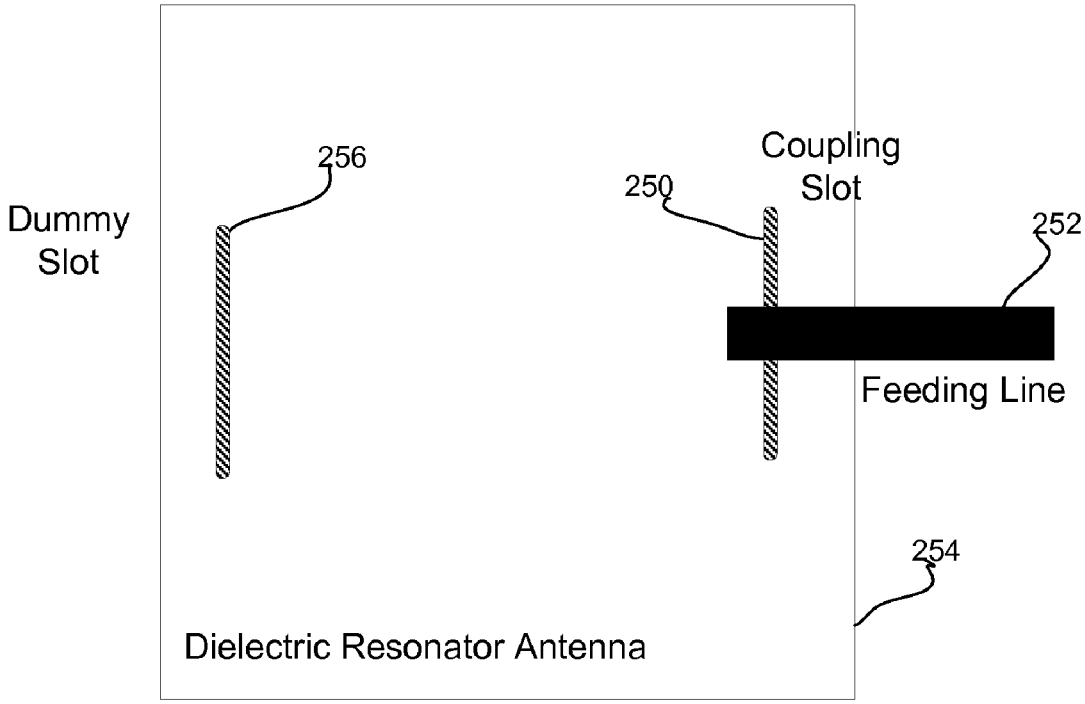
Figure 14:
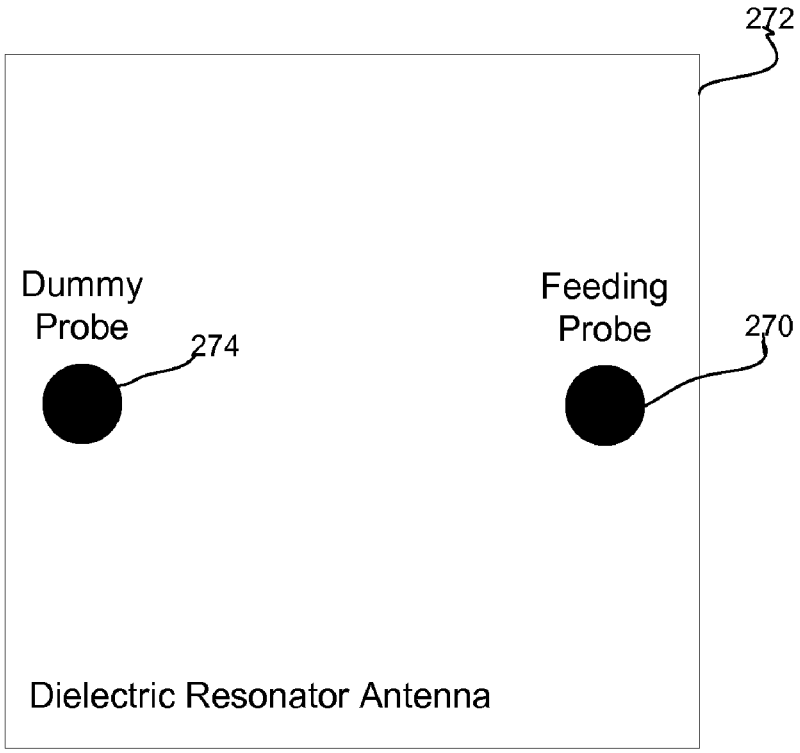
Figure 15:
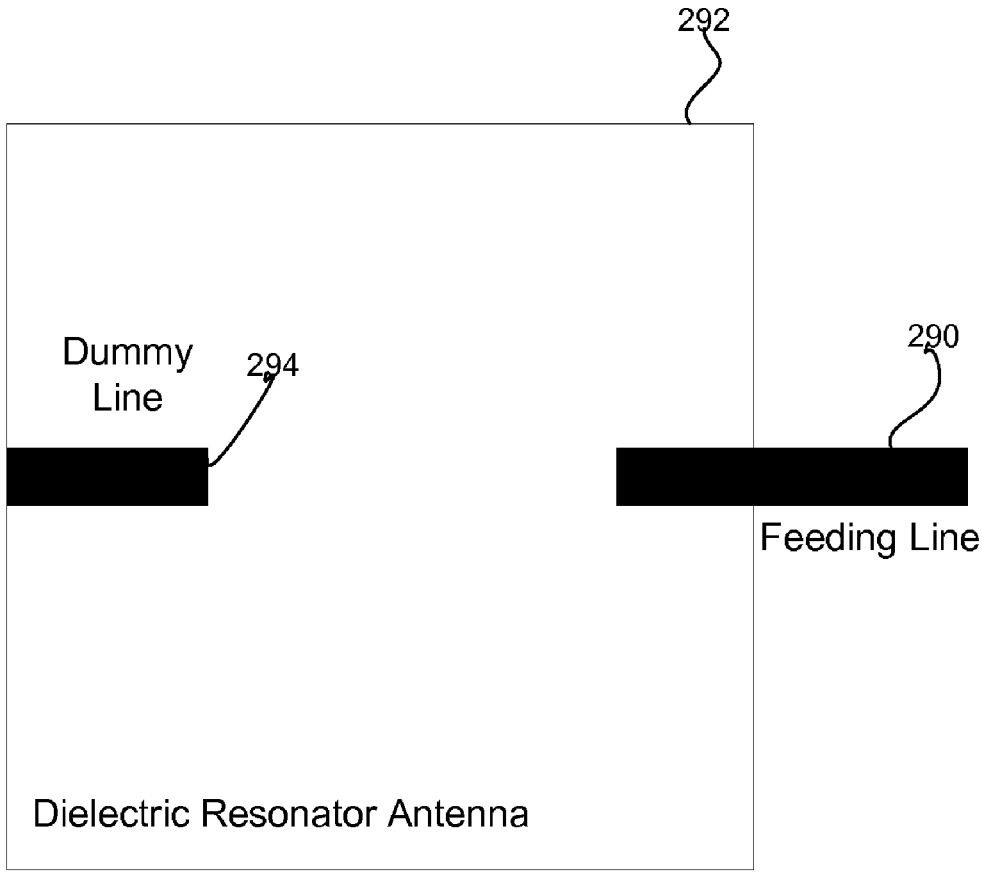

FIGS. 13, 14, and 15 illustrate top cross-sectional views of feeding structure embodiments using dummy structures to improve the field distribution symmetry of the antenna signal and polarization purity.

Figure 17:
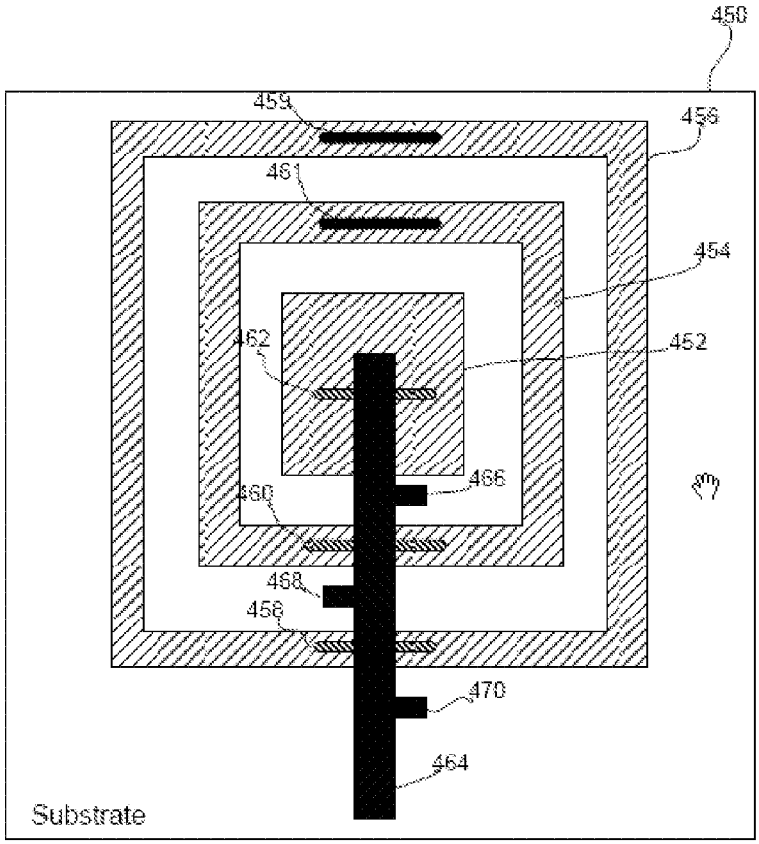

FIG. 13 illustrates a feeding structure comprising a coupling slot 250 coupled to a feeding line 252, where the coupling slot 250 is coupled to a dielectric resonator antenna 254, e.g., 4, 6, 8 and 14, 16, and 18. A dummy structure comprising slot 256 has the same feeding structure as coupling slot 250 and is not coupled to any feeding signal. FIG. 17 illustrates the coupling slot and dummy structures of FIG. 13 as implemented in multiple dielectric resonator antennas of FIG. 6. With respect to FIG. 17, a substrate 450 of a multi-band antenna is placed beneath the dielectric resonator antennas 452, 454, and 456, each coupled to a dedicated coupling slot 458, 460, and 462, respectively. The dielectric resonator antennas 452, 454, 456 are placed on the top of the ground plane of the substrate 450, and the coupling slots 458, 460, 462 are etched on the ground plane of the substrate 450. The coupling slots 458, 460, and 462 are coupled to a shared feeding line 464. Antennas 454 and 456 include dummy structures 461 and 459, respectively, such as the slots and dummy structures shown in FIG. 13.

FIG. 14 illustrates feeding structure comprising a feeding probe 270 coupled to a dielectric resonator antenna 272, e.g., 4, 6, 8 and 14, 16, and 18 to transmit and receive the signal. A dummy structure, i.e., dummy probe 274, has the same feeding structure as probe 270 and is not coupled to any feeding signal.

FIG. 15 illustrates a feeding structure comprising a feeding line 290 coupled to a dielectric resonator antenna 292, e.g., 4, 6, 8 and 14, 16, and 18, to transmit and receive the signal. A dummy structure comprising dummy line 294 has the same feeding structure as feeding line 290 and is not coupled to any feeding line.

Each dummy structure may be positioned parallel to a corresponding driven feeding structure and in a similar location with respect to an opposite side of the antenna being driven.

In a further embodiment, the polarization feeding structures of FIGS. 11-15 may be used in a dual polarization feeding structure, such that one feeding structure having a coupled feeding structure and dummy structure in the embodiments of FIGS. 11-15, are used for the horizontal polarization feeding structure and another of the same feeding structure would be used for the vertical polarization feeding structure.

Further, as discussed above, different antennas, e.g., 4, 6, and 8 in the multi-band antenna 2 may use different feeding structures in FIGS. 3-15 and different feeding structure arrangements, where the feeding structures may utilize feeding structure technologies, such as direct feeding with microstrip line structures, slot feeding with microstrip line, slot coupling with coplanar waveguide transmission line, etc. Some or all of the dielectric resonator antennas may be feed by a separate port. Alternatively, some or all of the dielectric resonator antennas may share the same feeding port by being coupled to a shared feeding line.

Figure 16:
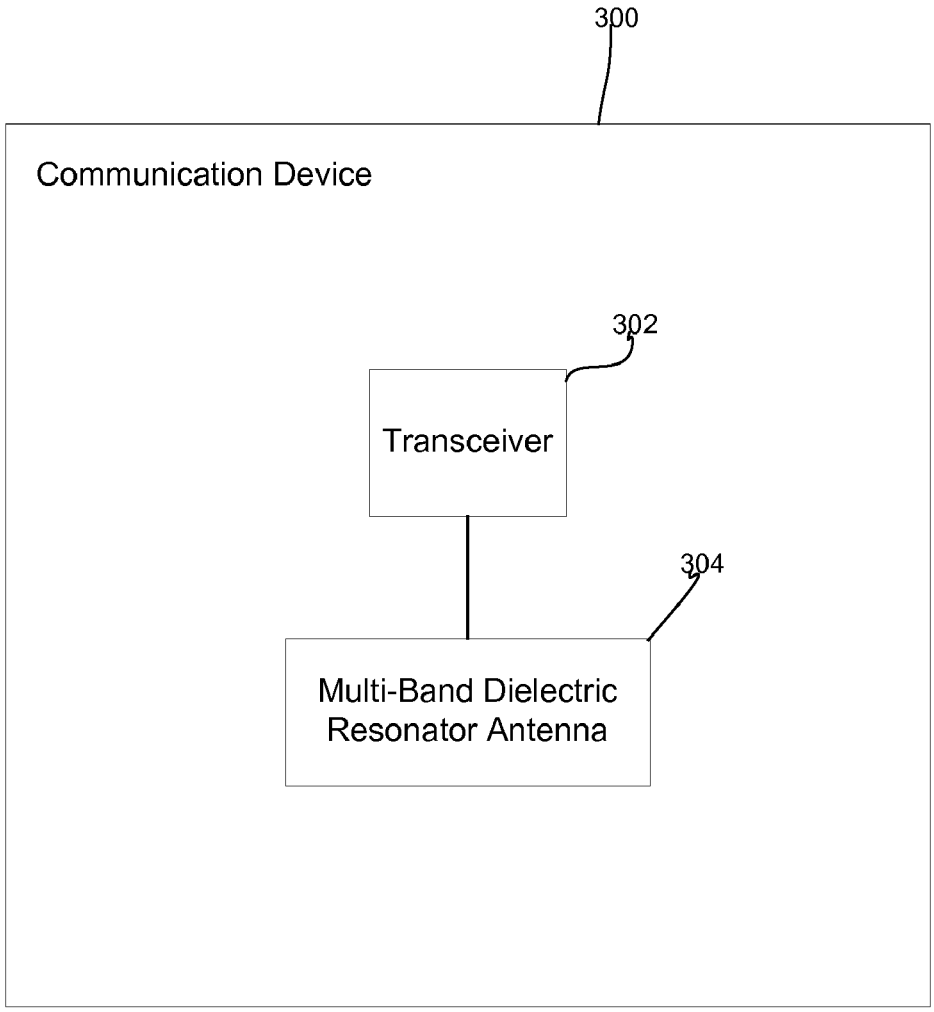
FIG. 16 illustrates an embodiment of a communication device having a multi-band dielectric resonator antenna.

FIG. 16 illustrates an embodiment of a communication device 300 having a transceiver 302 for receiving and transmitting the signals in the different frequency bands through a multi-band dielectric resonator antenna 304, such as multi-band dielectric resonator antennas 2 and 12. The communication device 300 may comprise a laptop, palmtop, or tablet computer having wireless capability, a personal digital assistant (PDA) having wireless capability, a cellular telephone, pagers, satellite communicators, cameras having wireless capability, audio/video devices having wireless capability, network interface cards (NICs) and other network interface structures, integrated circuits, and/or in other formats.

The transceiver 302 has the capability to handle signals transmitted and received in the different frequency bands provided by the antennas within the multi-band dielectric resonator antenna 304. The transceiver 302 may comprise multiple transceiver structures, such as a global positioning system (GPS) receiver, a cellular transceiver, a mobile TV receiver, a WiMAX transceiver, and a wireless network transceiver that are all operable within different frequency bands. The cellular transceiver may be configured in accordance with one or more cellular wireless standards (e.g., Global System For Mobile Communications (GSM), General Packet Radio Service (GPRS), Advanced Mobile Phone System (AMPS), Code Division Multiple Access (CDMA), wideband CDMA (WCDMA), CDMA 2000, and/or others). Similarly, the wireless network transceiver may be configured in accordance with one or more wireless networking standards (e.g., IEEE 802.11x, Bluetooth, HIPERLAN 1, 2, Ultra Wideband, HomeRF, WiMAX, and/or others).

The GPS receiver structure of the transceiver 302 may not be capable of transmitting signals and only receive signals from the multi-band dielectric resonator antenna 304. The cellular transceiver and the wireless network transceiver structures of the transceiver 302 receive signals from and deliver signals to the multi-band dielectric resonator antenna 304. The transceiver 302, e.g., GPS receiver, mobile TV receiver, cellular transceiver, and wireless network transceiver may each include functionality for processing both vertical polarization signals and horizontal polarization signals. For example, the transceiver 302 may include a combiner to combine vertical polarization receive signals and horizontal polarization receive signals during receive operations. The transceiver 302 may also include a divider to appropriately divide transmit signals into vertical and horizontal structures during transmit operations. The combiner and/or divider could alternatively be implemented within the antenna itself (or as a separate structure). The transceiver 302, such as in the GPS receiver structure, may include functionality for supporting the reception of circularly polarized signals from the multi-band dielectric resonator antenna 304.

It should appreciated that other types of receivers, transmitters, and/or transceivers may alternatively be coupled to the multi-band dielectric resonator antenna 304. In one embodiment, the multi-band dielectric resonator antenna 304 may be implemented on the same chip or integrated circuit substrate as the transceiver 302.

The foregoing description of various embodiments has been presented for the purposes of illustration and description. It is not intended to be exhaustive or to limit the embodiments to the precise form disclosed. Many modifications and variations are possible in light of the above teaching.

What is claimed is:

1. An antenna, comprising:

a first dielectric resonator antenna operative within a first frequency band;

a second dielectric resonator antenna operative within a second frequency band;

a first and second feeding structures electrically coupled to the first and second dielectric resonator antennas, respectively, to receive and transmit signals at the first and second frequency bands through the first and second dielectric resonator antennas;

a first dummy structure structurally identical to the first feeding structure but not coupled to a feeding signal; and a second dummy structure structurally identical to the second feeding structure but not coupled to a feeding signal.

2. The antenna of claim 1, wherein the first and second feeding structures are implemented in at least one feeding line electrically coupled to the first and second dielectric resonator antennas.

3. The antenna of claim 2, wherein the first feeding structure further comprises a first coupling slot to couple the first dielectric resonator antenna to the at least one feeding line and wherein the first feeding structure further comprises a second coupling slot to couple the second dielectric resonator antenna to the at least one feeding line.

4. The antenna of claim 2, wherein the at least one feeding line comprises a single feeding line in which the first and second feeding structures are implemented to which the first and second dielectric resonator antennas are electrically coupled.

5. The antenna of claim 2, wherein the at least one feeding line comprises a first feeding line to which the first dielectric resonator antenna is electrically coupled and a second feeding line to which the second dielectric resonator antenna is electrically coupled, wherein the first feeding structure comprises the first feeding line and wherein the second feeding structure comprises the second feeding line.

6. The antenna of claim 2, wherein a single coupling slot couples the first and second dielectric resonator antennas to the at least one feeding line.

7. The antenna of claim 1, wherein the first and second feeding structures comprise different feeding structure technologies.

8. The antenna of claim 1, where each of the first and second feeding structures have a horizontal polarization structure coupled to the associated first or second dielectric resonator antenna to transmit a portion of the signal having a horizontal polarization orientation and a vertical polarization structure coupled to the associated first or second dielectric resonator antenna to transmit a portion of the signal having a vertical polarization orientation.

9. The antenna of claim 1, where each of the first and second feeding structures have:

a feeding port;

a first and second feeding paths extending from the feeding port, wherein there is a gap between ends of the first and second feeding paths coupled to the associated first or second dielectric resonator antenna, wherein the first and second feeding paths have a phase difference.

10. The antenna of claim 1, where each of the first and second feeding structures have:

a first feeding port;

a second feeding port;

a first and second feeding paths extending from the first and second feeding ports, respectively, wherein there is a gap between ends of the first and second feeding paths coupled to the associated first or second dielectric resonator antenna, wherein the first and second feeding paths have a phase difference.

11. The antenna of claim 1, wherein the feeding and dummy structures comprise a structure that is a member of a set of structures comprising a probe, a slot, and a feeding line.

12. The antenna of claim 1, further comprising:

a third dielectric resonator antenna operative within a third frequency band; and a third feeding structure coupled to the third dielectric resonator antenna to further receive and transmit signals at the third frequency band through the third dielectric resonator antenna.

13. The antenna of claim 12, wherein the first dielectric resonator antenna comprises a disk, wherein the second dielectric resonator antenna comprises a first ring surrounding the first dielectric resonator antenna and wherein the third dielectric resonator antenna comprises a second ring surrounding the first ring.

14. The antenna of claim 12, wherein the antennas have a circular, square, elliptical or polygonal shape.

15. The antenna of claim 12, wherein at least two of the feeding structure structures employ different feeding structure technology.

16. The antenna of claim 1, wherein the second dielectric resonator surrounds the first dielectric resonator antenna.

17. An antenna, comprising:

a first dielectric resonator antenna operative within a first frequency band;

a second dielectric resonator antenna operative within a second frequency band;

a first feeding structure electrically coupled to the first dielectric resonator antenna to receive and transmit signals at the first frequency band through the first dielectric resonator antenna comprising:

a first coupling structure coupled to the first dielectric resonator antenna for a horizontal polarization orientation;

a second coupling structure coupled to the first dielectric resonator antenna for a vertical polarization orientation; and a first dummy structure identical to the first feeding structure but not coupled to a feeding signal;

a second feeding structure electrically coupled to the second dielectric resonator antenna to receive and transmit signals at the second frequency band through the second dielectric resonator antenna comprising:

a third coupling structure coupled to the second dielectric resonator antenna for a horizontal polarization orientation; and a fourth coupling structure coupled to the second dielectric resonator antenna for a vertical polarization orientation; and a second dummy structure identical to the second feeding structure but not coupled to a feeding signal.

18. An antenna, comprising:

a first dielectric resonator antenna operative within a first frequency band;

a second dielectric resonator antenna operative within a second frequency band;

a shared feeding structure electrically coupled to the first and second dielectric resonator antennas to receive and transmit signals at the first and second frequency bands through the first and second dielectric resonator antennas; and a shared dummy structure identical to the shared feeding structure coupled to the first and second dielectric antennas and not coupled to a feeding signal.

19. A communication device, comprising:

an antenna, comprising:

a first dielectric resonator antenna operative within a first frequency band;

a second dielectric resonator antenna operative within a second frequency band;

a first and second feeding structures electrically coupled to the first and second dielectric resonator antennas, respectively, to receive and transmit signals at the first and second frequency bands through the first and second dielectric resonator antennas;

a first dummy structure structurally identical to the first feeding structure but not coupled to a feeding signal;

a second dummy structure structurally identical to the second feeding structure but not coupled to a feeding signal; and a wireless transceiver coupled to the first and second feeding structures to receive and transmit the signals within the first and second frequency bands.

20. The communication device of claim 19, wherein the antenna further includes a third dielectric resonator antenna operative within a third frequency band and a third feeding structure coupled to the third dielectric resonator antenna to further receive and transmit signals at the third frequency band through the third dielectric resonator antenna.

21. The antenna of claim 19, wherein the second dielectric resonator surrounds the first dielectric resonator antenna.

22. The communication device of claim 19, wherein the first and second feeding structures are implemented in at least one feeding line electrically coupled to the first and second dielectric resonator antennas.

23. The communication device of claim 22, wherein the first feeding structure further comprises a first coupling slot to couple the first dielectric resonator antenna to the at least one feeding line and wherein the first feeding structure further comprises a second coupling slot to couple the second dielectric resonator antenna to the at least one feeding line.

24. The communication device of claim 22, wherein the at least one feeding line comprises a single feeding line in which the first and second feeding structures are implemented to which the first and second dielectric resonator antennas are electrically coupled.

25. The communication device of claim 22, wherein the at least one feeding line comprises a first feeding line to which the first dielectric resonator antenna is electrically coupled and a second feeding line to which the second dielectric resonator antenna is electrically coupled, wherein the first feeding structure comprises the first feeding line and wherein the second feeding structure comprises the second feeding line.

26. The communication device of claim 22, wherein a single coupling slot couples the first and second dielectric resonator antennas to the at least one feeding line.

27. A method, comprising:

operating a first dielectric resonator antenna operative within a first frequency band;

operating a second dielectric resonator antenna operative within a second frequency band;

transferring signals from and to the first and second dielectric resonator antennas through a feeding structure electrically coupled to the first and second dielectric resonator antennas to receive and transmit signals at the first and second frequency bands through the first and second dielectric resonator antennas;

transferring signals through a first coupling structure coupled to the associated first or second dielectric resonator antenna; and using a dummy coupling structure identical to the first coupling structure but not coupled to a feeding signal to improve symmetry of the electromagnetic field distribution associated with the signal and polarization purity.

28. The method of claim 27, wherein transferring the signals through the feeding structure further comprises transferring the signals through at least one feeding line electrically coupled to the first and second dielectric resonator antennas.

29. The method of claim 28, wherein the first coupling structure comprises at least one coupling slot to couple the first and second dielectric resonator antennas to the at least one feeding line.

30. The method of claim 27, wherein transferring the signals through the feeding structure further comprises:

transferring signals associated with the first dielectric resonator antenna through a first feeding structure; and transferring signals associated with the second dielectric resonator antenna through a second feeding structure, wherein the first and second feeding structures comprise different feeding structure technologies.

31. The method of claim 27, wherein transferring the signals through the feeding structure further comprises transferring the signals for the associated first and second dielectric resonator antennas by:

transferring a signal having a horizontal polarization through the first coupling structure coupled to the associated first or second dielectric resonator antenna; and transferring a signal having a vertical polarization through a second coupling structure coupled to the associated first or second dielectric resonator antenna.

32. The method of claim 27, wherein transferring the signals through the feeding structure further comprises transferring the signals for the associated first and second dielectric resonator antennas by:

transferring the signals through multiple paths to at least one feeding port.

33. The method of claim 27, further comprising:

operating a third dielectric resonator antenna operative within a third frequency band; and transferring signals from the third dielectric resonator antennas through the feeding structure electrically coupled to the third dielectric resonator antenna to receive and transmit signals at the third frequency band through the third dielectric resonator antenna.

34. The method of claim 27, wherein the second dielectric resonator antenna surrounds the first dielectric resonator antenna.

* * * * *